United States Patent [19]

Isomi

[11] 3,967,993

[45] July 6, 1976

[54] PROTECTED CONTAINER AND A PROCESS FOR PREPARING SAME

[75] Inventor: Yoshio Isomi, Nara, Japan

[73] Assignee: Sekisui Kaseihin Kogyo Kabushiki Kaisha, Nara, Japan

[22] Filed: Mar. 21, 1974

[21] Appl. No.: 453,649

[30] Foreign Application Priority Data

Mar. 23, 1973 Japan ..... 48-36054[U]

[52] U.S. Cl. ..... 156/86; 53/13; 156/229; 156/257; 156/294; 215/13 R; 264/230; 264/342 R; 428/35; 428/136; 428/179; 428/313

[51] Int. Cl.[2] ..... B29C 27/00; B32B 31/00

[58] Field of Search ..... 156/84, 85, 86, 294, 156/293, 229, 257, 270, 215; 215/12 R, 13 R, DIG. 6; 264/230, 342 R; 53/13; 428/35, 68, 136, 179, 313, 910

[56] References Cited

UNITED STATES PATENTS

| | | | |
|---|---|---|---|
| 3,128,895 | 4/1964 | Nelle | 215/12 R |
| 3,542,229 | 11/1970 | Beyerlein et al. | 156/86 |
| 3,698,586 | 10/1972 | Terner | 156/86 |
| 3,760,968 | 9/1973 | Amberg et al. | 215/12 R |
| 3,790,652 | 2/1974 | Colijn et al. | 156/85 |
| 3,825,141 | 7/1974 | Campagna | 215/12 R |

*Primary Examiner*—William A. Powell
*Assistant Examiner*—Brian J. Leitten
*Attorney, Agent, or Firm*—Armstrong, Nikaido & Wegner

[57] ABSTRACT

A protected container is formed by placing a protective coating of a foamed, heat shrinkable, styrenic resin sheet around at least a portion thereof. Slits are formed in the sheet prior to placing it around the container. After being placed around the container the sheet is heated so that it shrinks thereby making close contact with the container. The sheet is further heated such that the sides of the slits warp to form a rough surface to facilitate handling of the container.

3 Claims, 5 Drawing Figures

PROTECTED CONTAINER AND A PROCESS FOR PREPARING SAME

BACKGROUND OF THE INVENTION

1. Field of the Invention

This invention relates to a protected container and a process for preparing same.

2. Description of the Prior Art

Containers such as tumblers or bottles made of glass are often marred or damaged by collision between the contiguous containers when they are put together in a box and transported in contact with each other. When transporting the containers, therefore, care has hitherto been taken so as to avoid marring of the containers through mutual collision, and each of the containers are wrapped in paper, or separated by a partition wall and/or other packing materials.

However, when each of the containers is wrapped by paper, the container cannot be seen through the paper. Further, when the containers are separated by a partition wall or other packing materials, encasing operations become troublesome and costs are increased. Because these drawbacks occur as stated above, a need has been felt for a new method in which the containers are prevented from marring each other using easier packing operations and with more beautiful appearance.

In response to the needs, the Japanese patent application Ser. No. 47-12148 discloses a protected container and a process for preparing same, which comprises using heat-shrinkable, foamed sheet of thermoplastic resin material, placing a container into the sleeve so that the sleeve may enclose the side surface of the container including a portion having maximum circumferential dimension of the container and extending over considerable height of the container, heating the sleeve to cause shrinkage and thereby close contact with the surface of the container. The above application further discloses that polystyrene can be used for a material of the heat-shrinkable foamed sheet. However, the application does not contemplate a slit provided on the sleeve of the heat-shrinkable foamed sheet. Thus, the protected container which is prepared according to the above application has a smooth and sleek surface of the resin sheet, therefore it is apt to slip out of one's hand while it is carried in the hand. Thus, a new drawback has arisen in that the protected container tends to be destroyed by slipping out of the hand. The present invention has been made with an aim to eliminate the drawback.

SUMMARY OF THE INVENTION

The inventor has prepared a protected bottle by a process in which the heat-shrinkable foamed sleeve of thermoplastic resin sheet is provided with slits, all of which extend from the front to the back surface of the sheet, then a bottle is placed in the sleeve, and the sleeve is heated. It has been found that, when each of the slits is made to have the length of more than thickness of the sheet, and when each of the slits is provided in such a direction that the length of the slits run perpendicular to the highly stretched direction of the sleeve, both side peripheries of each of the slits are outwardly warped and the warped peripheries are considerably hardened due to shrinkage of the sheet. It has further been found that the protected bottle thus obtained does not slip out of one's hand when carried by the hand, and that damage which is caused by mutual collision of the bottles is also lessened. This invention has been completed on the basis of the above findings.

According to the present invention, there is provided a protected container which comprises a container and a foamed sytrenic resin sheet covering the container, which sheet is in the form of a sleeve to enclose the container and closely contact a part of the side surface of the container. The part includes at least two surface portions adversely tapered, whereby the sheet is firmly secured to the container without the use of an adhesive. The sheet is provided with a number of holes extending from the front to the back of the sheet, the peripheries of which are partly warped in the outward direction of the container and hardened by decrease in foams compared with the remaining portion of the sheet.

The present invention further provides a process for preparing a protected container which process comprises using a sleeve made of foamed heat-shrinkable styrenic resin sheet, which has been stretched to a high degree in the circumferential direction of the sleeve, and which is provided with a number of slits having a length of more than the thickness of the sheet and running in a direction which makes an angle of less than $\pm$ 70° to the line perpendicular to the said stretched direction of the sheet. A container is placed in the sleeve so that the sleeve may surround a part of the side surface of the container including at least two surface portions adversely tapered, and the slits of the sheet may be located at a protruding side surface of the container. The sleeve is heated to a temperature between the softening temperature and flow beginning temperature of the resin to shrink the sleeve so as to cause close contact with the surface of the container. The heating of the sleeve is continued after the contact, until both sides of each of the slits have been warped outwardly to form a hole and foams on both side have been diminished.

DESCRIPTION OF THE DRAWINGS

This invention will be explained by way of an example shown in the drawings, in which.

PREFERRED EMBODIMENT OF THE INVENTION

Figure 1:
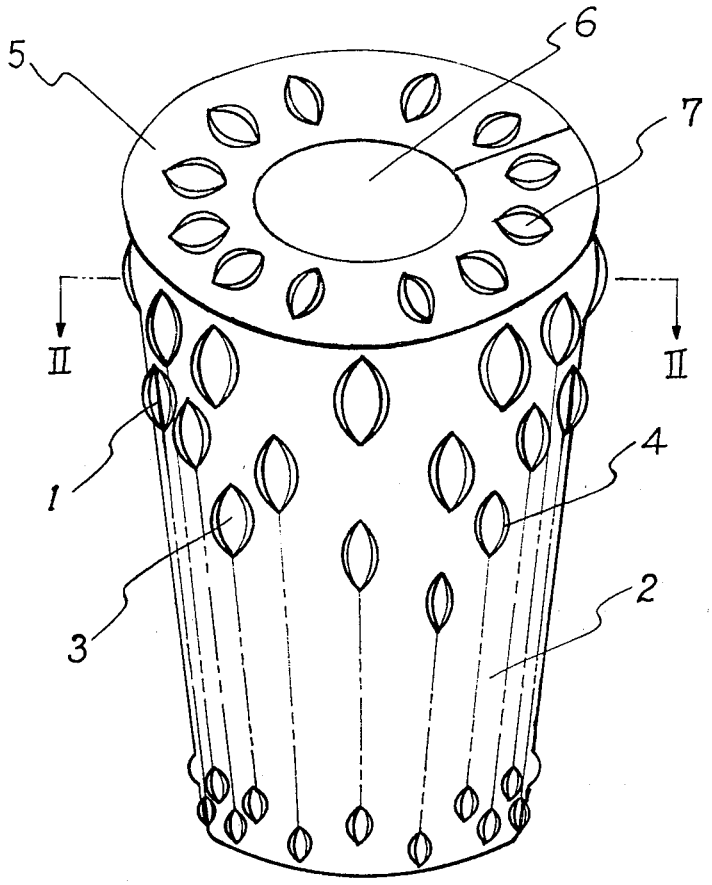
FIG. 1 is a perspective view of a protected container in the present invention, wherein a tumbler is used as the container.
Figure 2:
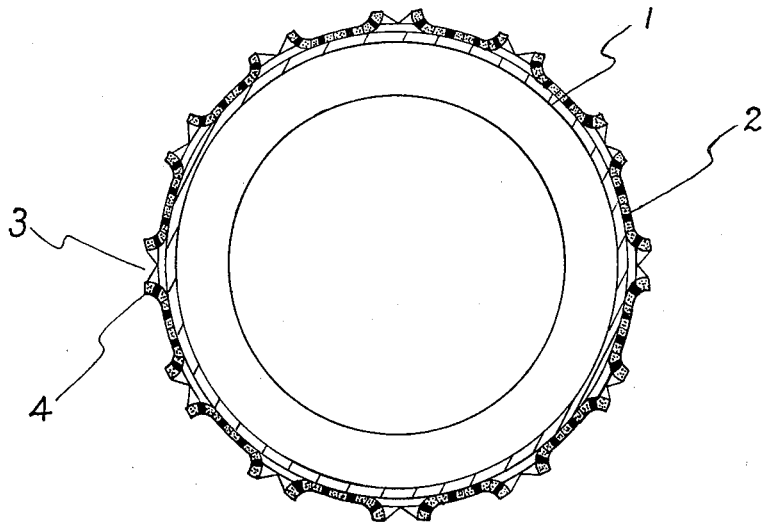
FIG. 2 is a sectional view of the container taken along II—II line in FIG. 1.

In FIG. 1, foamed styrenic resin sheet 2 covers tumbler 1 which is made of glass. Sheet 2 is formed into a sleeve and encloses tumbler 1, as shown in FIG. 2. Sheet 2 is inwardly bent to form flat surface 5 at the opening mouth of tumber 1. Flat surface 5 exists only in the vicinity of periphery of the opening mouth of tumbler 1, and thus aperture 6 is formed in the central portion of flat surface 5. Holes 7 are provided in flat surface 5. It is desirable but is not necessary to provide flat surface 5 with holes 7. Sheet 2 is in almost the same state at the bottom of tumbler 1 as at the opening mouth.

Sheet 2 is provided with holes 3. Holes 3 are located in such a manner that longitudinal direction of holes 3 may coincide with the axial direction of the sleeve. Side peripheries 4 of holes 3 are warped in the outward direction of the tumbler 1, as shown in FIG. 2. Side peripheries 4 are decreased in foaming up ratio and become hard compared with the remaining portion in sheet 2. Thus, the protected tumbler has a rough surface, and accordingly it will not slip out of one's hand.

Figure 3:
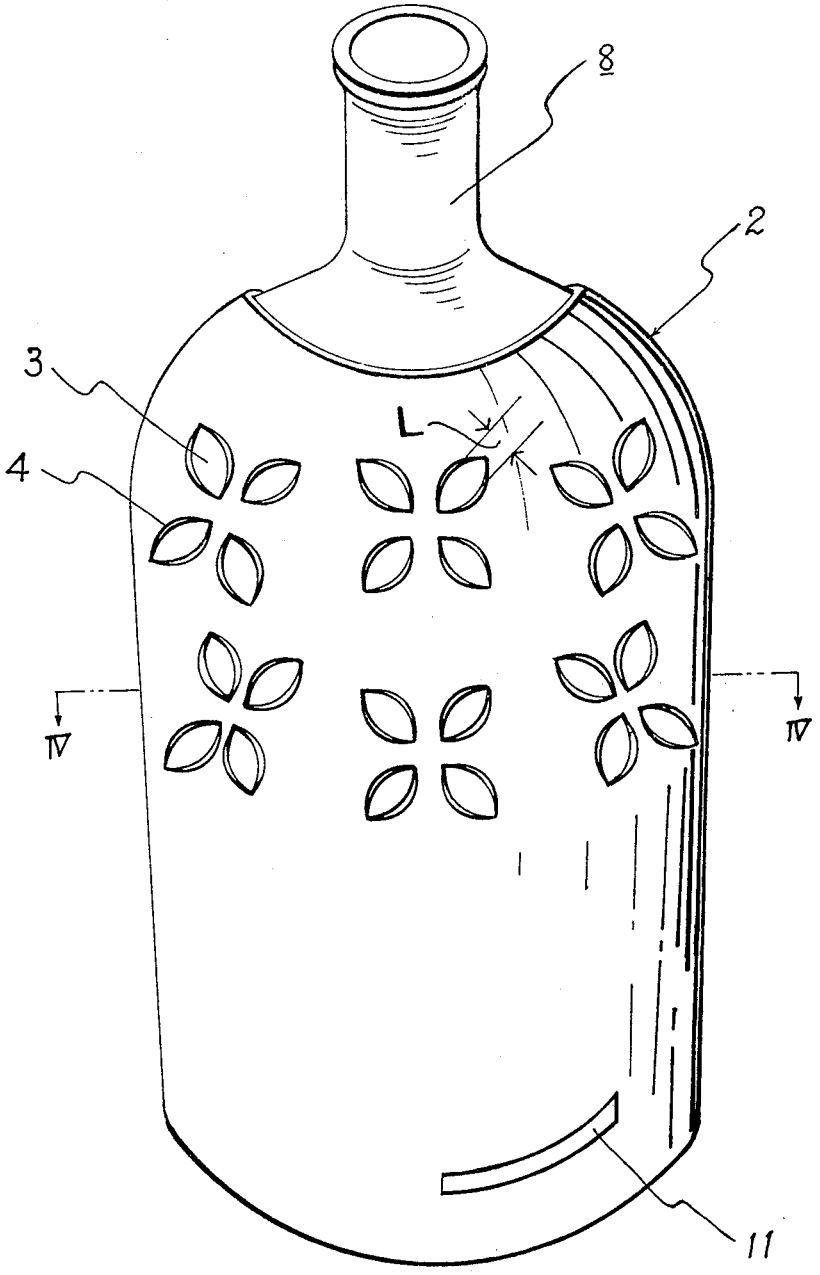
FIG. 3 is a perspective view of another protected container in the present invention, wherein a bottle is used as the container.

In FIG. 3, foamed sheet of styrenic resin 2 covers bottle 8 which is made of glass. Sheet 2 is shaped in an annular form and encloses bottle 8. The upper end of sheet 2 is situated at the shoulder of bottle 2, and the lower end of sheet 2 is curved along the bottom surface of bottle 8, wherein sheet 2 exists only in the peripheral portion of the bottom, leaving an aperture in the central portion. Sheet 2 is provided with holes 3, and the periphery of each of holes 3 is partly warped outward at 4 in FIG. 4. The warped periphery is decreased in foaming ratio and becomes hard compared with the remaining portion in sheet 2. Thus, the protected bottle has a rugged surface, and accordingly, it will not slip out of one's hand.

Figure 5:
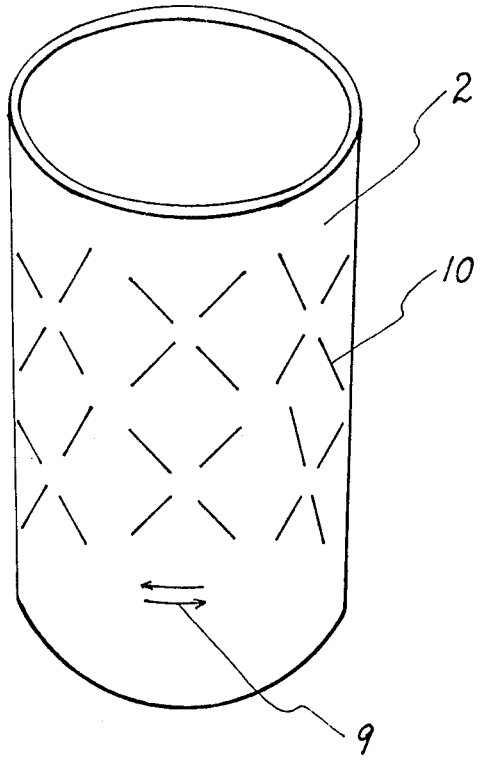
FIG. 5 is a perspective view of a sleeve for use in preparing the protected bottle as shown in FIG. 3.

In order to prepare the protected bottle as shown in FIG. 3, a sleeve is used which is shown in FIG. 5. In FIG. 5, sleeve 2 is made of a foamed heat-shrinkable sheet of styrenic resin. The sheet has been stretched to a high degree in the circumferential direction of sleeve 2, indicated by arrow 9. Thus, sleeve 2 has the property that it shrinks considerably in the direction of arrow 9 when it is heated at a temperature between the softening temperature and flow beginning temperature of the resin. Therefore, sleeve 2 is shrinkable so as to decrease its diameter. To sleeve 2 has been added a number of slits 10. Slits 10, are made for example, by cutting sleeve 2 with a razor blade, and slits 10 extend from the front surface to the back of the sheet constituting sleeve 2. Each of slits 10 should not run in the direction parallel to that shown by arrow 9, but should run in the direction perpendicular or at a slant to that shown by arrow 9.

When bottle 8 is inserted into sleeve 2 provided with slits 10, and sleeve 2 is heated at a temperature between the softening temperature and flow beginning temperature of the resin, sleeve 2 shrinks considerably in the circumferential direction to contact closely with the side surface of bottle 8. At this time, if the upper and lower ends of sleeve 2 are located respectively at the shoulder and the bottom of bottle 8, the ends are curved along the shoulder and the bottom, and thus sleeve 2 forms two portions which are adversely tapered to each other i.e., an upward tapered portion at the shoulder of bottle 8 and downward tapered portion at the bottom of bottle 8. When sleeve 2 is further heated for a while, slits 10 are gradually opened and both side peripheries 4 of each of the slits 10 are warped in the outward direction of bottle 8. As the result, peripheries 4 turn to be heated both from the front and back surfaces, and consequently cause considerable shrinkage in the foams contained therein, to form hardened protrusions. Thus, the protected bottle of this invention has holes 3 and hardened protrusions 4 formed around each of the holes 3.

The foamed styrenic sheet is commonly prepared by impregnating styrenic resin with foaming agent to form a foamable composition, and extruding the composition from a die mounted on an extruder to form a sheet. In this case, it is preferable to use as the foaming agent aliphatic hydrocarbons such as propane, butane and pentane. The styrenic resin includes polystyrene, styrene copolymers, and blended mixtures of them. The copolymers and the blended mixtures are limited to those, wherein styrene is predominant in weight. Examples of the copolymer are styrene-methyl methacrylate, styrene-alpha-methyl styrene, styrene-acrylonitrile, styrene-ethylene.

The heat-shrinkable foamed sleeve used in this invention may be manufactured by the process wherein the foamed styrenic sheet as noted above is at first prepared, then the sheet is heated at a temperature slightly above the softening temperature of the styrenic resin. The heated sheet is stretched to a high degree in one direction to form a shrinkable sheet, thereafter the shrinkable sheet is bent in said direction so as to overlap both ends, and overlapped portions are adhered to each other. In this case, adhering of the overlapped portions may be carried out by use of an adhesive or by melting the overlapped portions. The sheet is provided with the slits at an appropriate time after stretching of the sheet and prior to adhering of the overlapped portions. The heat-shrinkable foamed sleeve may be prepared by the process wherein the foamed sheet is initially formed in a tubular shape, then the sheet is heated at said temperature, and the heated sheet is stretched in the circumferential direction. In this case, slits should be made in the sheet at an appropriate time after the sheet has been stretched.

Slit 10 should have a shape which is long in one direction. That is, slit 10 may have some width, however, the width should be small compared with the length. Preferably the slit is a line slit which has no substantial width or rectangular slit which has long sides which are much longer than the short sides. The slit should not have a square or circular shape. Further, the length should be more than the thickness of the sheet. A line slit having the length from several millimeters to several centimeters is most preferable and it may be easily formed by cutting the sheet with a razor blade.

Figure 4:
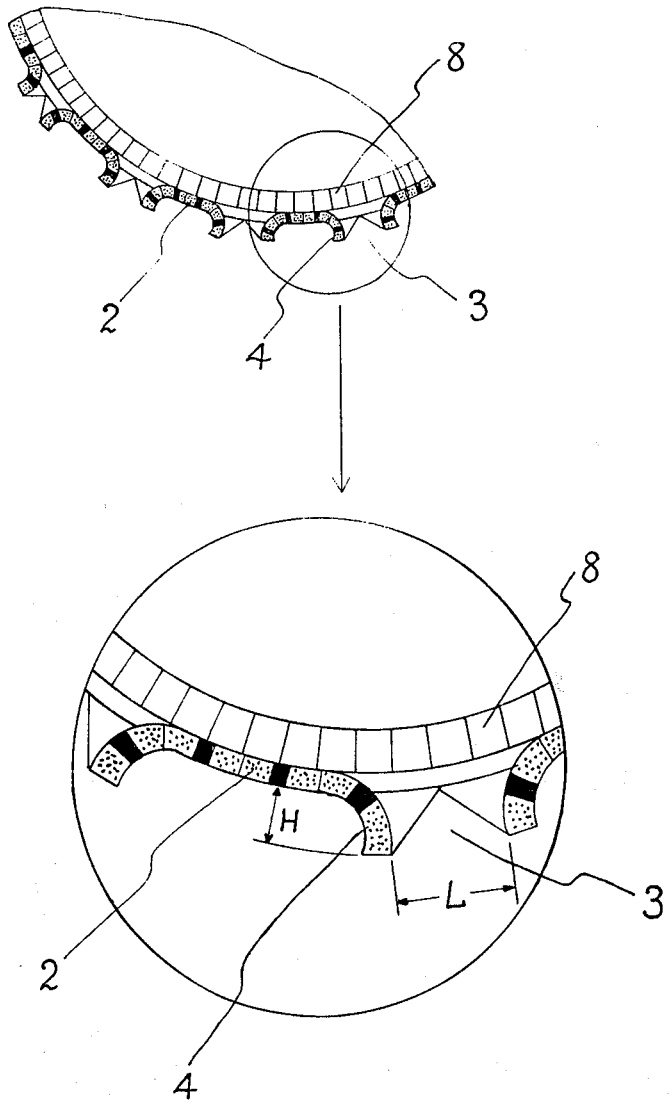
FIG. 4 is an enlarged sectional view, partly cut away, of the container taken along IV—IV line in FIG. 3.

Slit 10 should be made in the sleeve so as to run in a direction which makes an angle of less than $\pm 70°$ to the line perpendicular to the stretched direction of the sheet. The limitation that the angle should be less than $\pm 70°$ is derived from a result of experiments. The experiments were carried out using a heat-shrinkable sleeve of foamed polystyrene sheet which was prepared by stretching a foamed polystyrene sheet to a high degree in the circumferential direction of the sleeve. A number of line slits which had the length of about 10mm and no substantial width were made in the sleeves, varying the direction in which each of the slits runs in the sleeve. A bottle was inserted into the sleeve, and the sleeve was heated together with the bottle to cause shrinkage of the sleeve. As the result, it has been found that, when the slits are made in the sleeve in the direction perpendicular to the stretched direction in the sleeve, both width opening L and warping height H become maximum wherein width opening L represents the maximum width in each hole measured in the width direction of each hole, and warping height H represents the maximum protruding height in each periphery at each hole measured in the perpendicular direction of the bottle surface portion in which the holes exists, as shown in FIGS. 3 and 4. Further, it has been found that, when the slits run in a direction which makes an angle within the range of $\pm 70°$ to said perpendicular direction, the warping height H is sufficient, however, when said angle is more than ± 75° the warping height H is insufficient. It has also been found that, when said angle is less than ± 55°, the warping height H is conspicuous. Therefore, the slit should be provided in the sleeve in such a manner that said angle may be less than ± 70°, preferably less than ± 55°.

Covering is completed if only the sleeve provided with the slits is heated, after a container has been inserted into the sleeve, and the sleeve has been located at the necessary position on the surface of the container. In order to heat the sleeve, it is preferable to use the hot air, but it may be possible to use hot water or steam. When heated, the sleeve gives rise to shrinkage and closely contacts the surface of the container simultaneously both side peripheries of the slits warp outwardly. Thus, the covering is carried out with a simple operation, whereby a protected container can be obtained.

The protected container in this invention has the following advantages. Since covering material in the protected container is made of the foamed sheet of styrenic resin, it has good characteristics as a cushioning material, and therefore the protected container is damaged less even when the protected containers are transported in contact with each other without the use of any further separating material. Further, the covering material has hard portions warping outwardly, thus, when the protected containers collide with each other, these portions come into contact. The warped portion has a good cushioning action, therefore, damage to the container owing to mutual collisions is lessened. Furthermore, if a number of hard warped portions are densely distributed over the entire surface of the covering material in this invention, the covering material may be decreased in its thickness and a thinner covering material can sufficiently protect the container. The possibility that the container may slip out of one's hand is decreased because the covering material has a rough surface due to holes and hard warped portions. Therefore, the protected container in this invention can be safely handled compared with conventional containers. In addition, the protecting sheet in this invention has a number of holes, through which the side surface of the container can be seen, and therefore, if the container is made of transparent material, the consumed state of contents can be seen from the outside. Still more, since the sheet covering the container is tubular and includes at least two surface portions adversely tapered in the container, the sheet can be firmly fixed to the container without adhesive and will never drop away from the container, so that the container is sufficiently protected by sheet.

When the protecting sheet covers a label adhered to the container, the label cannot be seen from outside, because the foamed sheet of styrenic resin is opague. However, such a label can be easily made visible by pressing the heated iron to the portion to melt the sheet locally, whereby foams are crushed in the sheet and the sheet turns into a transparent thin film which connects with the foamed sheet still remaining around the container. An example of the transparent portion is indicated by numeral reference 11 in FIG. 3. Thus, the foamed styrenic resin sheet covering the container can be partly made transparent, which serves to enable one to read the label and to impart the container with a good appearance.

The process of the invention will further be explained in detail by way of an example as follows.

EXAMPLE

Into an extruder having the outlet of 65 mm in inside diameter was supplied polystyrene containing 1.5% by weight of butane and 5% by weight of finely divided talc. The polystyrene was made molten by heating and kneaded in the extruder at 180° C to form gelled mixture containing a foaming agent. The gel was extruded from an annular orifice of a die mounted on the forward end of said extruder at a rate of 21 Kg/hr to form a tubular sheet. Dimensions of the orifice were 85mm in the inside diameter and 0.5 mm in width. A mandrel having the outside diameter of 202 mm was mounted on the forward end of said die. The extruded tubular sheet was passed over said mandrel at the rate of 5.3 m/min to stretch the tubular sheet mainly in the circumferential direction and then it is cut open into two sheets, each of which was used as a heat-shrinkable sheet of foamed styrenic resin in this invention.

The sheet was 0.45 mm in thickness and is 0.238 g/cm$^3$ in bulk density. When the sheet was heated at 135° C for 15 minutes, the sheet is shrunk by 10% in a direction and by 54% in another direction perpendicular to the said direction. A rectangular piece having the dimensions of 125 mm by 250 mm was cut from the sheet in such a manner that the side having the length of 250 mm was laid parallel to the direction of 54% shrinkage, the other side having the length of 125 mm was laid parallel to the direction of 10% shrinkage. A number of slits having the length of 10 mm and no substantial width were cut in said rectangular piece by a razor blade in two directions making the angles of ± 45° to each of both sides. The piece was rounded so as to form a tube, both ends having the length of 125 mm were overlapped and fused together by heating to obtain a sleeve having the diameter of 79 mm. The sleeve thus obtained is as shown in FIG. 5, wherein slits 10 are provided in the direction making ± 45° to the stretched direction 9.

A bottle having the maximum diameter of 77 mm was inserted into the sleeve, then the sleeved bottle was placed in a thermostat, and heated by the hot air at 150° C for 30 seconds to shrink the sleeve, which made close contact with the surface of the bottle. In the course of this process, it was observed that the sleeve began to shrink 10 – 15 seconds from the start of the heat, thereafter both sides of slits 10 warped outwardly to produce holes 3, followed by hardening. Thus, a protected bottle was obtained, which was in appearance as shown in FIG. 3, except for transparent portion 11.

As to the protected bottle thus obtained, warping height H and opened length L at holes 3, which are shown in FIGS. 3 and 4, were measured and found that mean value of H was 0.95 mm, that of L was 2.5 mm. Owing to this, the protected bottles does not slip out of one's hand when carried, and can safely be transported without marring the bottle merely by arranging a number of the protected bottles in contact with each other, i.e., without use of any further partition walls and other stuffing materials.

The present invention may be embodied in other specific forms without departing from the spirit or essential characteristics thereof. The presently disclosed embodiments are therefore to be considered in all respects as illustrative and not restrictive, the scope of the invention being indicated by the appended claims rather than the foregoing description, and all changes which come within the meaning and range of equivalency of the claims are therefore intended to be embraced therein.

I claim:

1. A progress for placing a protective coating of a foamed, heat shrinkable, styrenic resin sheet around at least a portion of a container, said process comprising:

a. stretching said sheet in a first direction;

b. forming a plurality of slits in said sheet said slits being positioned at less than ± 70° to the perpendicular to said first direction;

c. surrounding at least a portion of said container with said sheet;

d. heating said sheet to a temperature between the softening and melting temperature of said resin whereby said sheet shrinks to closely contact said portion of said container; and, e. further heating said sheet until the side of said slits warp outward and harden to form a hole with a raised hardened portion at each side.

2. The process of claim 1, wherein said sheet is a sleeve and said first direction is the circumferential direction thereof.

3. The process of claim 1, wherein said portion of said container includes at least two surface portions adversely tapered.

* * * * *